US005655940A

United States Patent [19]

Hodson et al.

[11] Patent Number: 5,655,940

[45] Date of Patent: Aug. 12, 1997

[54] CREATION OF A LARGE FIELD EMISSION DEVICE DISPLAY THROUGH THE USE OF MULTIPLE CATHODES AND A SEAMLESS ANODE

[75] Inventors: Lester L. Hodson, McKinney; Charles E. Primm, Plano, both of Tex.

[73] Assignee: Texas Instruments Incorporated, Dallas, Tex.

[21] Appl. No.: 463,955

[22] Filed: Jun. 5, 1995

Related U.S. Application Data

[62] Division of Ser. No. 314,036, Sep. 28, 1994.

[51] Int. Cl.[6] ..... H01J 1/30; H01J 9/18

[52] U.S. Cl. ..... 445/24; 345/42; 313/495; 313/584

[58] Field of Search ..... 445/24; 348/797; 345/41, 42, 80; 313/495, 497, 584, 585, 519

[56] References Cited

U.S. PATENT DOCUMENTS

| | | | |
|---|---|---|---|
| 3,614,509 | 10/1971 | Willson | 313/584 X |
| 3,755,704 | 8/1973 | Spindt et al. | 313/309 |
| 3,863,090 | 1/1975 | Pennebaker, Jr. | 313/585 |
| 3,996,490 | 12/1976 | Miller | 313/585 |
| 4,156,833 | 5/1979 | Wey et al. | 345/80 |
| 4,233,623 | 11/1980 | Parliscka | 348/797 |
| 4,455,774 | 6/1984 | Watanabe | 313/519 X |
| 4,833,542 | 5/1989 | Hara et al. | 345/903 |
| 4,857,799 | 8/1989 | Spindt et al. | 345/74 |
| 4,940,916 | 7/1990 | Borel et al. | 313/306 |
| 5,067,021 | 11/1991 | Brody | 345/903 |
| 5,153,483 | 10/1992 | Kishino et al. | 315/169.1 |
| 5,194,780 | 3/1993 | Meyer | 315/169.3 |
| 5,202,674 | 4/1993 | Takemori et al. | 345/75 |
| 5,225,820 | 7/1993 | Clerc | 340/752 |
| 5,277,638 | 1/1994 | Lee | 445/24 |
| 5,300,862 | 4/1994 | Parker et al. | 345/74 |
| 5,347,199 | 9/1994 | Van Gorkom et al. | 313/422 |
| 5,386,172 | 1/1995 | Komatsu | 313/304 |
| 5,488,386 | 1/1996 | Yamagishi et al. | 345/74 |
| 5,505,649 | 4/1996 | Park | 445/50 |

*Primary Examiner*—Kenneth J. Ramsey
*Attorney, Agent, or Firm*—Rose Alyssa Keagy; Richard L. Donaldson

[57] ABSTRACT

One anode 350 and multiple cathodes 50, 60, 70, and 80 create a large display field emission device. The use of one anode 350 facilitates an image which is seamless to the viewer. The use of multiple cathodes 50, 60, 70, and 80 allows a single image or multiple images to be displayed. The use of multiple cathodes also provides fast refresh rates and a high resolution image. Methods of fabricating and operating the large display field emission device are disclosed.

1 Claim, 3 Drawing Sheets

CREATION OF A LARGE FIELD EMISSION DEVICE DISPLAY THROUGH THE USE OF MULTIPLE CATHODES AND A SEAMLESS ANODE

This is a division of application Ser. No. 08/314,036, filed Sep. 28, 1994.

TECHNICAL FIELD OF THE INVENTION

The present invention relates generally to field emission flat panel display devices and, more particularly, to the use of multiple cathodes and a single anode to create a large field emission device display.

BACKGROUND OF THE INVENTION

For more than half a century, the cathode ray tube (CRT) has been the principal electronic device for displaying visual information. The widespread usage of the CRT may be ascribed to the remarkable quality of its display characteristics in the realms of color, brightness, contrast and resolution. One major feature of the CRT permitting these qualities to be realized is the use of a luminescent phosphor coating on a transparent faceplate.

Conventional CRT's, however, have the disadvantage that they require significant physical depth, i.e., space behind the actual display surface, making them bulky and cumbersome. They are fragile and, due in part to their large vacuum volume, can be dangerous if broken. Furthermore, these devices consume significant amounts of power.

The advent of portable computers and other miniaturized devices has created intense demand for displays which are light-weight, compact and power efficient. The space available for the display function of these devices precludes the use of a conventional CRT. Accordingly, significant efforts have been made to provide satisfactory flat panel displays having display characteristics, e.g., brightness, resolution, versatility in display and power consumption which are comparable or superior to those of CRT's. These efforts, while producing flat panel displays that are acceptable for some applications, have not produced a display that can compare to a conventional CRT.

Currently, liquid crystal displays are used almost universally for laptop and notebook computers. In comparison to a CRT, these displays provide poor contrast, permit only a limited range of viewing angles, and, in color versions, consume power at rates which are incompatible with extended battery operation. In addition, color liquid crystal screens tend to be far more costly than CRT's of equal screen size.

As a result of the drawbacks of liquid crystal display technology, thin film field emission display technology has been receiving increasing attention from industry. Flat panel displays utilizing such technology employ a matrix-addressable array of pointed, thin-film, cold field emission cathodes in combination with an anode comprising a phosphor-luminescent screen.

The phenomenon of field emission was discovered in the 1950's, and extensive research by many individuals has improved the technology to the extent that its prospects for use in the manufacture of inexpensive, low-power, high-resolution, high-contrast, full-color flat displays appear to be promising.

Advances in field emission display (FED) technology are disclosed in U.S. Pat. No. 3,755,704, "Field Emission Cathode Structures and Devices Utilizing Such Structures," issued 28 Aug. 1973, to C. A. Spindt et al.; U.S. Pat. No. 4,940,916, "Electron Source with Micropoint Emissive Cathodes and Display Means by Cathodoluminescence Excited by Field Emission Using Said Source," issued 10 Jul. 1990 to Michel Borel et al.; U.S. Pat. No. 5,194,780, "Electron Source with Microtip Emissive Cathodes," issued 16 Mar. 1993 to Robert Meyer; and U.S. Pat. No. 5,225,820, "Microtip Trichromatic Fluorescent Screen," issued 6 Jul. 1993, to Jean-Frédéric Clerc. These patents are incorporated by reference into the present application.

The Clerc ('820) patent discloses a field emission flat panel display having a glass substrate on which are deposited a matrix of conductors. In one direction of the matrix, conductive columns comprising the cathode electrode support multiple microtips. In the other direction, above the column conductors, are perforated conductive rows comprising the gate electrode. The row and column conductors are separated by an insulating layer having holes permitting the passage therethrough the microtips, each intersection of a row and column corresponding to a pixel.

One area for improvement of field emission displays of the current technology is in increasing the display size. The largest display size realized by today's technology is approximately 8"×6" (10" diagonal). What is needed is an ability to manufacture larger size displays for use in systems such as engineering work stations. More ideally, what is needed is a large FED display where one high resolution image can be viewed and updated independently of at least one other image.

SUMMARY OF THE INVENTION

A large display electron emission apparatus comprises a memory, at least one microprocessor coupled to the memory, a controller coupled to the microprocessor, and at least two row drivers and at least two column drivers coupled to the controller. The apparatus further comprises at least two emitter plates coupled to the row and column drivers, and one anode coupled to the emitter plates.

In a first embodiment, the controller operates a first emitter plates independently of all other emitter plates. In a second embodiment the anode is also coupled to the controller and the controller operates one section of the anode independently of other sections of the anode. Methods of fabricating and operating the large display field emission device are disclosed.

BRIEF DESCRIPTION OF THE DRAWING

The foregoing features of the present invention may be more fully understood from the following detailed description, read in conjunction with the accompanying drawings, wherein.

DETAILED DESCRIPTION

Figure 1:
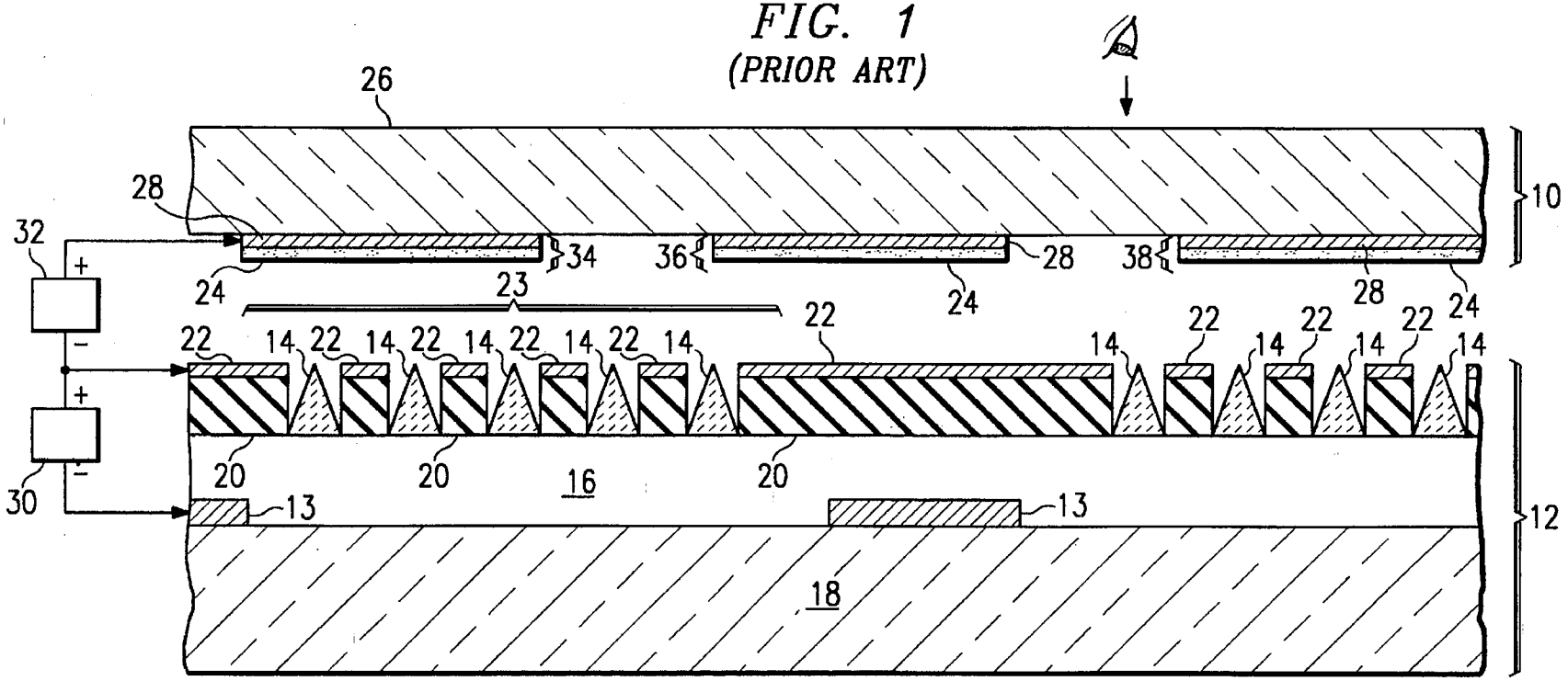
FIG. 1 (PRIOR ART)
FIG. 1 is a cross-sectional view of a portion of a field emission display according to a preferred embodiment of the present invention.

Referring initially to FIG. 1, there is shown, in cross-section, a portion of one prior art embodiment of a field emission flat panel display device incorporated into the present invention. In this embodiment, the field emission device comprises an anode plate 10 having an electroluminescent phosphor coating 24 facing an emitter plate 12, the phosphor coating 24 being observed from the side opposite to its excitation (as indicated on FIG. 1).

More specifically, the illustrative field emission device of FIG. 1 comprises a cathodoluminescent anode plate 10 and an electron emitter (or cathode) plate 12. A cathode portion of emitter plate 12 includes conductors 13 formed on an insulating substrate 18, an electrically resistive layer 16 also formed on substrate 18 and overlaying the conductors 13, and a multiplicity of electrically conductive microtips 14 formed on the resistive layer 16. In this example, the conductors 13 comprise a mesh structure, and microtip emitters 14 are configured as a matrix within the mesh spacings.

A gate electrode includes a layer of an electrically conductive material 22 which is deposited on an insulating layer 20 which overlies the resistive layer 16. The microtip emitters 14 are in the shape of cones which are formed within apertures through the conductive layer 22 and the insulating layer 20. The respective thicknesses of the gate electrode layer 22 and the insulating layer 20 are chosen in such a way that the apex of each microtip 14 is substantially coplanar with the electrically conductive gate electrode layer 22. The conductive layer 22 is arranged as rows of conductive bands across the surface of the substrate 18, and the mesh structure of conductors 13 is arranged as columns of conductive bands across the surface of substrate 18, thereby permitting selection of microtips 14 at the intersection of a row and column corresponding to a pixel.

The anode 10 includes an electrically conductive film 28 deposited on a transparent planar support 26. The film is positioned parallel to gate electrode 22. The conductive film 28 may be in the form of a continuous coating across the surface of the support 26; alternatively, it may be in the form of electrically isolated stripes 34, 36, 38 comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive. Anode 10 also includes a cathodoluminescent phosphor coating 24, deposited over the conductive film 28 so as to be directly facing and immediately adjacent the gate electrode 22. In the Clerc ('820) patent, the conductive bands of each series 34, 36, 38 are covered with a phosphor coating 24 which luminesces in one of the three primary colors, red, blue and green. FIG. 1 demonstratively shows a first and second color stripe 34 and 36, and the beginning of a third color stripe 38. A preferred process for applying the phosphor coating 24 to the conductive film 28 comprises electrophoretic deposition.

One or more microtip emitters 14 of the above-described structure are energized by applying a negative potential to the conductors 13, functioning as the cathode electrode, relative to the gate electrode 22, via a voltage supply 30, thereby producing an electric field between anode 10 and emitter plate 12 which draws electrons from the apexes of the microtips 14. The freed electrons are accelerated toward the anode plate 10 which is positively biased by the application of a substantially larger positive voltage from a voltage supply 32 coupled between the gate electrode 22 and conductive regions 28 functioning as the anode electrode. Energy from the electrons attracted to the anode conductors 28 is transferred to the phosphor coating 24, resulting in luminescence. The electron charge is transferred from phosphor coating 24 to the conductive regions 28, completing the electrical circuit to voltage supply 32.

It is to be noted and understood that true scaling information is not intended to be conveyed by the relative sizes and positioning of the elements of anode plate 10 and the elements of emitter plate 12 as depicted in FIG. 1. For example, in a typical FED shown in FIG. 1 there are ten sets, or matrixes, of microtips 23 and there are three color stripes 34, 36, and 38 per display pixel.

Figure 2:
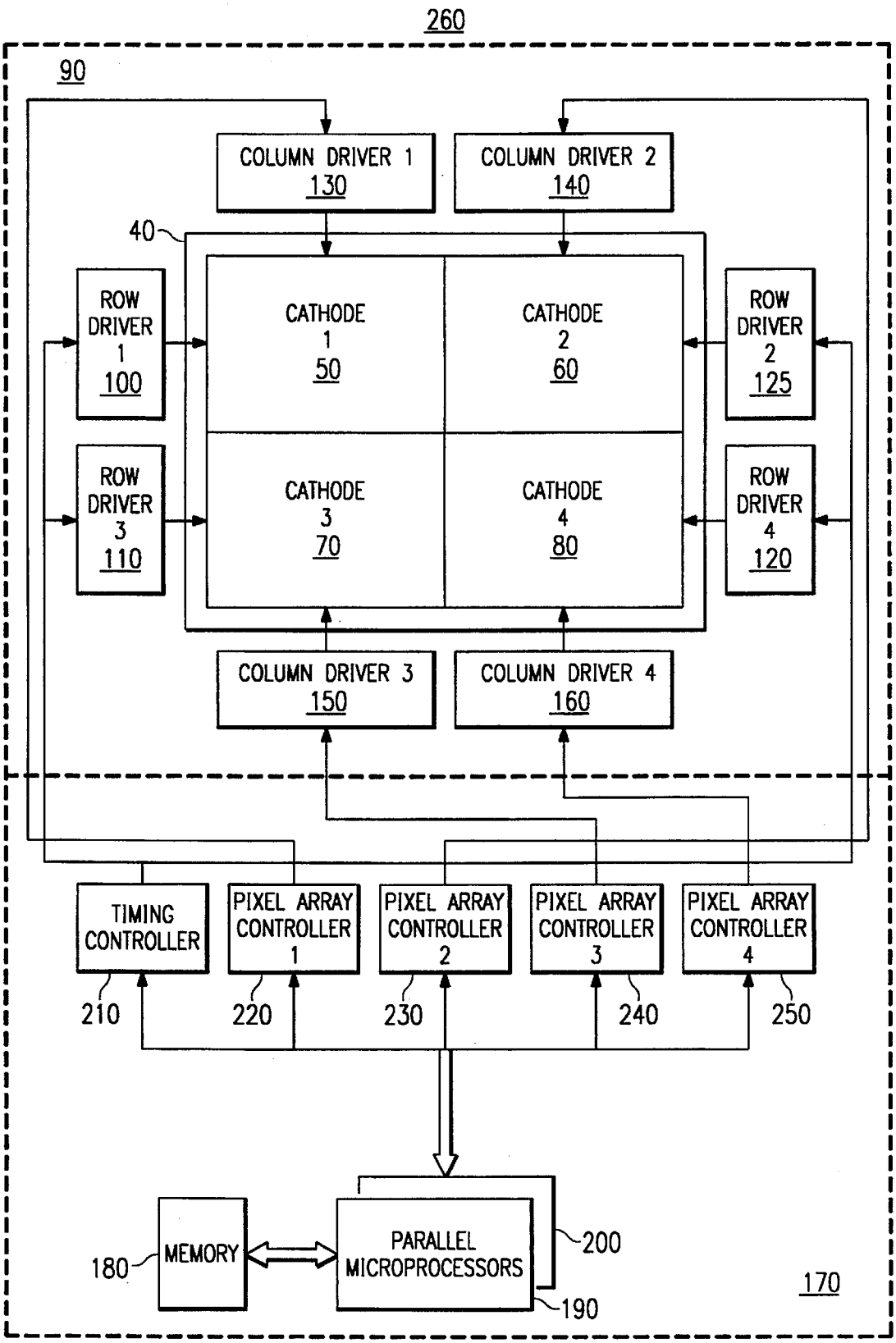
FIG. 2 is a schematic diagram of a portion of the large FED display system of the present invention.

In accordance with the principles of the present invention and as shown in FIG. 2, a large FED 40 is fabricated having a first emitter plate 50, a second emitter plate 60, a third emitter plate 70, and a fourth emitter plate 80. Emitter plates 50, 60, 70, and 80 may be similar to the emitter plate 12 of FIG. 1. The display 40 is physically located on a panel 90. Also located on the panel 90 are row drivers 100, 110, 120, and 125, as well as column drivers 130, 140, 150, and 160. In the preferred embodiment row and column drivers 100 and 130 send the data and control signals needed for the operation of a first emitter plate, 50, and row and column drivers 125 and 140 send the data and control signals needed for the operation of a second emitter plate, 60. Likewise, row and column drivers 110 and 150 send the data and control signals needed for the operation of a third emitter plate, 70, and row and column drivers 120 and 160 send the data and control signals needed for the operation of a fourth emitter plate, 80.

Also in accordance with the principles of the present invention, the large FED display system base 170 is fabricated having all necessary FED system electronics including a memory 180, microprocessors 190 and 200, a timing controller 210 and pixel array controllers 220, 230, 240, and 250. The memory 180 stores all of the information needed for the emitter plates 50, 60, 70, and 80 of large display 40. At least two microprocessors 190 and 200, operating in parallel are needed to accomplish the task of correctly formatting and controlling the transfer of data from memory 180 to emitter plates 50, 60, 70, and 80. As microprocessors become more powerful in the future, just one such microprocessor may be capable of servicing the large FED system. Parallel microprocessors 190 and 200 also facilitate the proper operation of emitter plates 50, 60, 70, and 80 thereby enabling display 40 to project one large picture incorporating all four emitter plates, or multiple pictures with at least one emitter plate creating one image and the remaining emitter plates creating one or more remaining images.

Timing controll 210 is coupled between parallel microprocessors 190 and 200, and row drivers 100, 110, 120, and 125. Timing controller 210 provides horizontal line control information, vertical sync information, and clock signals required by the row drivers to properly display each image. Array controllers 220, 230, 240, and 250 provide the control signals and character information needed by column drivers 130, 140, 150, and 160 respectively for each column of display 40. Electrical interconnection between the electrical devices in panel 90 and base 170 is accomplished through the use of a flex circuit which is not shown.

Figure 3:
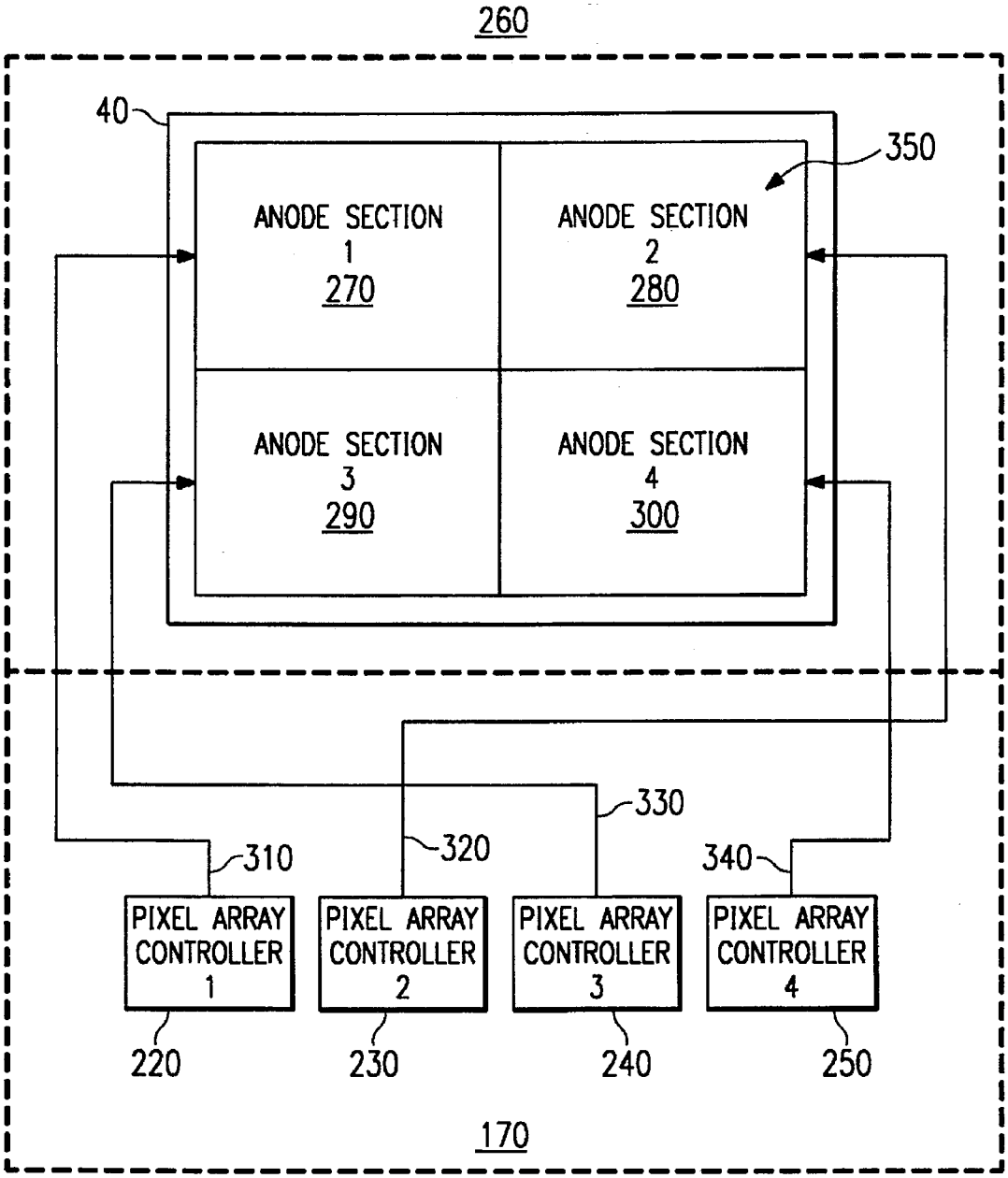
FIG. 3 is a schematic diagram of another portion of the large FED display system of the present invention.

FIG. 3 shows the single anode plate 350 which overlays the plurality of emitter plates 50, 60, 70, and 80 shown in FIG. 2. As shown in FIG. 3, the same pixel array controllers 220, 230, 240, and 250, located on the base 170, provide the control signals needed to supply the proper voltages to sections 270, 280, 290, and 300 respectively of a single anode 350. Single anode 350 may be similar to anode 10 of FIG. 1. Control signals on lines 310, 320, 330, and 340 provide the control information for all three anode colors (red, green, and blue). The four anode sections 270, 280, 290, and 300 can operate separately or in concert because each anode section is powered and controlled separately. For instance, one anode section 270 could be displaying an image in color while another anode section 280 displays an image in monochrome, both while anode sections 290 and 300 are black because their power is off.

Other electronic components necessary for the operation of the large display FED system 260 which are not necessary to the understanding of this invention are not shown. For example panel 90 and base 170 would have a power supplies for providing power to all system 260 components.

Base panel 90, shown in FIG. 2, is the support structure for all display electronics such as the row and column drivers 100, 110, 120, 125, 130, 140, 150, and 160, the multiple emitter plates 50, 60, 70, and 80, the single anode 350 and the interconnects between these components (not shown). An illustrative method for fabricating a panel 90, shown in FIG. 2, for use in a large FED display system 260 incorporating the principles of the present invention comprises the following steps. In the preferred embodiment, the panel 90 is a glass substrate. The glass substrate 90 is first patterned to provide pads for mounting panel components such as the row driver 100. The mounting pads are created by first depositing by evaporation or sputtering a conductive metal layer, which may typically comprise aluminum, molybdenum, chromium or niobium, onto substrate 90 to a thickness of approximately 100–500 nm. A layer of photoresist, illustratively type AZ-1350J sold by Hoescht-Celanese of Somerville, N.J., is then spun on over the metal layer to a thickness of approximately 1000 nm. Next, a patterned mask is disposed over the light-sensitive photoresist layer. This exposes desired regions of the photoresist to light. The mask used in this step defines the mounting pads. In the case of this illustrative positive photoresist, the exposed regions are removed during the developing step, which may comprise soaking the assembly in a caustic or basic chemical such as Hoescht-Celanese AZ-developer. The developer removes the unwanted photoresist regions which were exposed to light. The exposed regions of the conductive layer are then removed, typically by a reactive ion etch (RIE) process using carbon tetrafluoride ($CF_4$). The remaining photoresist layer is now removed by a wet etch process using acetone or toluene as the etchant. The portions of the metal layer which remain comprise the above-described mounting pads.

Multiple emitter plates 50, 60, 70, and 80, which are electrically independent from one another, are now mounted to glass substrate 90. Each of these emitter plates are constructed such that their electrical interconnects (not shown) to their respective row and column drivers will be on a boundary edge of display 40. For example, Cathode 1, 50, will have its row driver interconnect located on the left side of the emitter plate, and its column driver interconnect located on the top side of the emitter plate. Customizing the cathode interconnect locations in this manner allows the emitter plates 50, 60, 70, 80 to be placed against each other on substrate 90.

The ability to place the emitter plates against each other helps to facilitate a image on display 40 which is seamless to the viewer; the space between the images created by each emitter plate is no greater than the resolution of the pixels. The use of multiple electrically independent emitter plates provides the capability of displaying and updating one picture independent of other pictures.

Next, in the fabrication of panel 90, a single anode plate 350, shown in FIG. 3, is sealed to emitter plates 50, 60, 70, and 80. The anode plate 350 has numerous red, green, and blue phosphor stripes 34, 36, and 38, just like the standard FED display anode shown in FIG. 1. However, anode 350 is controlled in four sections by pixel array controllers 220, 230, 240, and 250 as shown in FIG. 3. The advantage of using a single anode 350 is that it facilitates a display image on display 40 which is seamless when viewed by the user.

After the anode 350 has been sealed to emitter plates 50, 60, 70, and 80, the row and column drivers are first mounted to substrate 90, and then electrically interconnected to their respective emitter plate. Electrical interconnect bonding between the drivers and the emitter plates can be accomplished by many methods in common use today. For example row driver 100 can be bonded to emitter plate 50 by connecting, by heat or ultrasound, a gold wire bridge between the two components. As a final step in the fabrication of panel 90, the flex circuit interconnect (not shown) between panel 90 and base 170 is now mounted to panel 90 using standard flex to glass adhesives.

Several other variations in the above processes, such as would be understood by one skilled in the art to which it pertains, are considered to be within the scope of the present invention. For example, one very powerful controller could replace the four controllers 220, 230, 240, and 250. Additionally, more than four emitter plates could be tiled, or abutted, together to construct a display 40 which is larger than that shown in FIG. 2. To accomplish the tiling of more than four emitter plates, the interconnects, such as the interconnects between the row drivers and their emitter plates, could be provided by imbedding leads in silicon on top of glass substrate 90.

The use of multiple emitter plates and a single anode, as disclosed herein, has numerous advantages. First, a large display can be constructed for applications where a large viewing area is critical, such as in an engineering workstation or for presentations to larger groups of people in a conference room setting. Second, the high resolution of today's smaller display FED's is available with the large FED display through the use of multiple emitter plates. Third, the large display FED takes up less physical space than is needed by large display's of other technologies such as the CRT (cathode ray tube). Fourth, because each emitter plate is working separately, fast refresh rates ( e.g. 72 Hz needed for video refresh) can be maintained by refreshing only the length of the row of each emitter plate separately, instead of refreshing the total row length of the large display. Fifth, multiple images can be viewed and updated independently of the other images.

Still other advantages can be obtained with this invention. FED displays use less power and are lighter weight than other display technologies such as the CRT. Additionally, fabrication costs are reduced because each emitter plate can be built and tested with currently developed technology.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. A method of fabricating a large display electron emission apparatus comprising the steps of:

providing an insulating substrate;

depositing a conductive layer on a surface of said substrate;

coating said conductive layer with photoresist;

applying a patterned mask over said photoresist and developing said photoresist to remove selected portions of said conductive layer;

removing any remaining photoresist;

mounting at least two emitter plates to said substrate;

sealing one anode to said emitter plates;

mounting row and column drivers on said conductive layer;

bonding electrically conductive interconnects between said emitter plates and said row and column drivers;

providing an electrical connection between said row and column drivers and control circuitry.

* * * * *